US005552168A

United States Patent [19]

Cameron-Price

[11] Patent Number: 5,552,168

[45] Date of Patent: Sep. 3, 1996

[54] CARBONATED BEVERAGE PACKAGE

[76] Inventor: Ernest J. Cameron-Price, Regent House, Poolhead Lane, Tanworth-in Arden, Solihull, West Midlands, B94 5ED, England

[21] Appl. No.: 30,174

[22] PCT Filed: Jul. 10, 1991

[86] PCT No.: PCT/GB91/01139

§ 371 Date: Mar. 16, 1993

§ 102(e) Date: Mar. 16, 1993

[87] PCT Pub. No.: WO92/00897

PCT Pub. Date: Jan. 23, 1992

[30] Foreign Application Priority Data

Jul. 11, 1990 [GB] United Kingdom ..... 9015239
Aug. 4, 1990 [GB] United Kingdom ..... 9017131

[51] Int. Cl.[6] ..... B65B 25/00; B65B 31/00

[52] U.S. Cl. ..... 426/106; 426/112; 426/115; 426/123; 426/131; 220/906

[58] Field of Search ..... 426/106, 112, 426/115, 124, 131, 397, 398, 394, 474, 477; 53/420, 432, 433, 471, 474; 220/906

[56] References Cited

U.S. PATENT DOCUMENTS 3,578,210 5/1971 Pitroiffy-Szabo .
3,741,383 6/1973 Wittwer .
4,272,019 6/1981 Halaby, Jr. ..... 239/8
4,399,158 8/1983 Bardsley et al. ..... 426/112

FOREIGN PATENT DOCUMENTS 0064932 11/1982 European Pat. Off. .
0227213 7/1987 European Pat. Off. .
359051 1/1962 France .
2002976 7/1970 Germany .
1331425 10/1970 United Kingdom .

OTHER PUBLICATIONS

Webster's 3rd New International Dictionary, P. Gove, Ed. in Chief, G & C Merriaim Company, Mass. 1961 p. 324.

*Primary Examiner*—Donald E. Czaja
*Assistant Examiner*—Curtis E. Sherrer
*Attorney, Agent, or Firm*—Quarles & Brady

[57] ABSTRACT

Various arrangements of gas reservoir can be provided for containing a gas such as nitrogen in a carbonated beverage can, the reservoirs being generally of tubular form and/or having a tubular attachment portion by which the reservoir is secured to one of the can end walls. The tube may have a plug and socket connection with one or both can end walls to hold the reservoir in a fixed position, but one end of the tube may simply abut with the can end wall by means of a lug. One or more orifices in the tube, through which gas passes into the beverage when the can is opened, are provided in the tube sidewall, in the step, or in one end of the tube. The tube may be a force-fit in a hole (18) in one end wall of the can.

7 Claims, 6 Drawing Sheets

CARBONATED BEVERAGE PACKAGE

FIELD OF THE INVENTION

This invention relates to a beverage package and to a method of packaging a beverage. The invention relates in particular to a beverage package comprising means for initiating the production of bubbles in a beverage.

BACKGROUND OF THE INVENTION

A beverage package has been proposed in specification EP 0 227 213A2 which comprises a beverage container, such as a conventional aluminium can, in the lower part of which is located a plastics pod charged with nitrogen. The pod is provided with a small orifice, and when the can is opened thereby relieving the pressure in the main chamber of the can, nitrogen ejected through the orifice bubbles into the beverage to initiate the production of further bubbles from gas dissolved in the beverage.

The pod is desirably located in the bottom of the main chamber such that when the can is opened, the bubbles rise through the full depth of the beverage. The pod in EP 0 227 213A2 is provided with flexible tabs to engage frictionally the can side-wall. However, since beer cans have to be heated to pasteurise the contents, the pod may rise during the heating cycle.

SUMMARY OF THE INVENTION

According to one aspect of the present invention, a beverage package comprises a sealed, openable container defining a beverage chamber containing a beverage in which a gas is dissolved, the beverage being confined by the container at a super-atmospheric pressure, and a gas reservoir assembly housed in the beverage chamber, the gas reservoir assembly comprising a reservoir housing which is attached to the container, the gas reservoir being positioned in or extending into the lower region of the beverage chamber, that region opposite to the openable end of the container, and an orifice means leading from the gas chamber of the gas reservoir into said lower region.

The orifice means may be permanently open, or it may be arranged to be opened or uncovered prior to pouring the beverage.

Preferably the attachment is between the reservoir housing and the basal wall of the container, that wall which is opposite to the openable end of the container.

Preferably the attachment is by means of a push fit between complementary formations provided respectively on the reservoir housing and basal wall.

The complementary formations are preferably so arranged that they inter-engage and hold when-the reservoir housing is pushed downwardly against the basal wall.

Preferably the formations comprise a spigot on the basal wall or reservoir housing which is received within a cylindrical socket in the reservoir housing or basal wall respectively.

The spigot and socket are preferably centrally disposed of the basal wall and reservoir housing such that the relative angular orientation of the reservoir housing and basal wall during the push-fitting operation does not matter.

One wall of the spigot and socket connection may be grooved to provide an orifice, or the housing may be formed with a hole to provide an orifice.

The reservoir housing can be of any desired shape, but an advantageous construction employs a tubular housing, one end of the tube constituting one of said complementary formations.

The reservoir housing can be a stepped tube, the orifice means being provided by at least one axially-extending hole in the step of the tube.

The provision of the orifice means in a step in a tube enables the orifice means to be formed by relatively conventional molding tools.

When the reservoir housing is tubular the housing may comprise a plurality of cup-shaped members which are adapted to be sealably secured to one another, the base of at least one of the cud members being formed with a hole to provide the orifice means.

The opposite end of the tube to said one end may be attached to an upper wall of the container, or to a partition wall of the container.

Alternatively, the attachment comprises a push fit between complementary formations provided respectively on or in the reservoir housing and on or in a first wall of the container, and the arrangement is such that the reservoir housing abuts with a further wall of the container, said further wall opposing said first wall so as to retain the complementary formations engaged, thereby preventing the reservoir housing from becoming displaced in the container.

The provision of an abutment between the reservoir housing and the further wall is simpler to produce than a positive location means.

The abutment is conveniently provided by a lug on the reservoir housing, which lug is directed towards the further wall. The orifice means may then be positioned adjacent to the lug and confronting the further wall.

The attachment can be by means of a headed retainer extending sealably through one wall of the container.

An advantage of this arrangement is that the container wall may not require substantial shaping to provide the attachment.

The retainer may be in the form of an independently-formed plug, rivet or threaded fastener, or it may be an integral portion of the reservoir housing.

According to a second aspect of the invention, a beverage package comprises a sealed, openable container defining a beverage chamber containing a beverage in which a gas is dissolved, the beverage being confined by the container at a super-atmospheric pressure, and a gas reservoir containing gas at super-atmospheric pressure, the gas reservoir being provided by a tube which has one end co-operating with a formation on or in the basal wall of the container, and the opposite end of the tube co-operating with a formation on or in a further wall of the container.

Preferably, when the container is a can said further wall is the top wall of the can, that wall which is provided with an openable portion for opening by suitable means, such as a ring-pull means.

The tube is preferably sealably attached to the further wall to seal the upper end of the gas chamber.

The connection between said one end of the tube and the formation of the basal wall preferably incorporates a passage to provide an orifice means providing restricted communication between the gas chamber and the beverage chamber. Alternatively, however, the tube could be provided with one or more radial holes at a position spaced axially from said connection.

The passage is preferably defined by a recess in one of the mating surfaces of said one end of the tube and said formation of the basal wall, and by at least one radial recess in the extremity of said one end of the tube.

According to a third aspect of the invention, a container for a beverage package in accordance with the second aspect of the invention is charged with beverage prior to insertion of the tube into the container, and the tube is first attached to the upper wall of the container prior to securing the upper wall on the container.

BRIEF DESCRIPTION OF THE DRAWINGS

Various beverage packages in accordance with the invention will now be described, by way of example only, with reference to the accompanying schematic drawings in which.

DETAILED DESCRIPTION OF THE PREFERRED EMBODIMENTS

Figure 1:
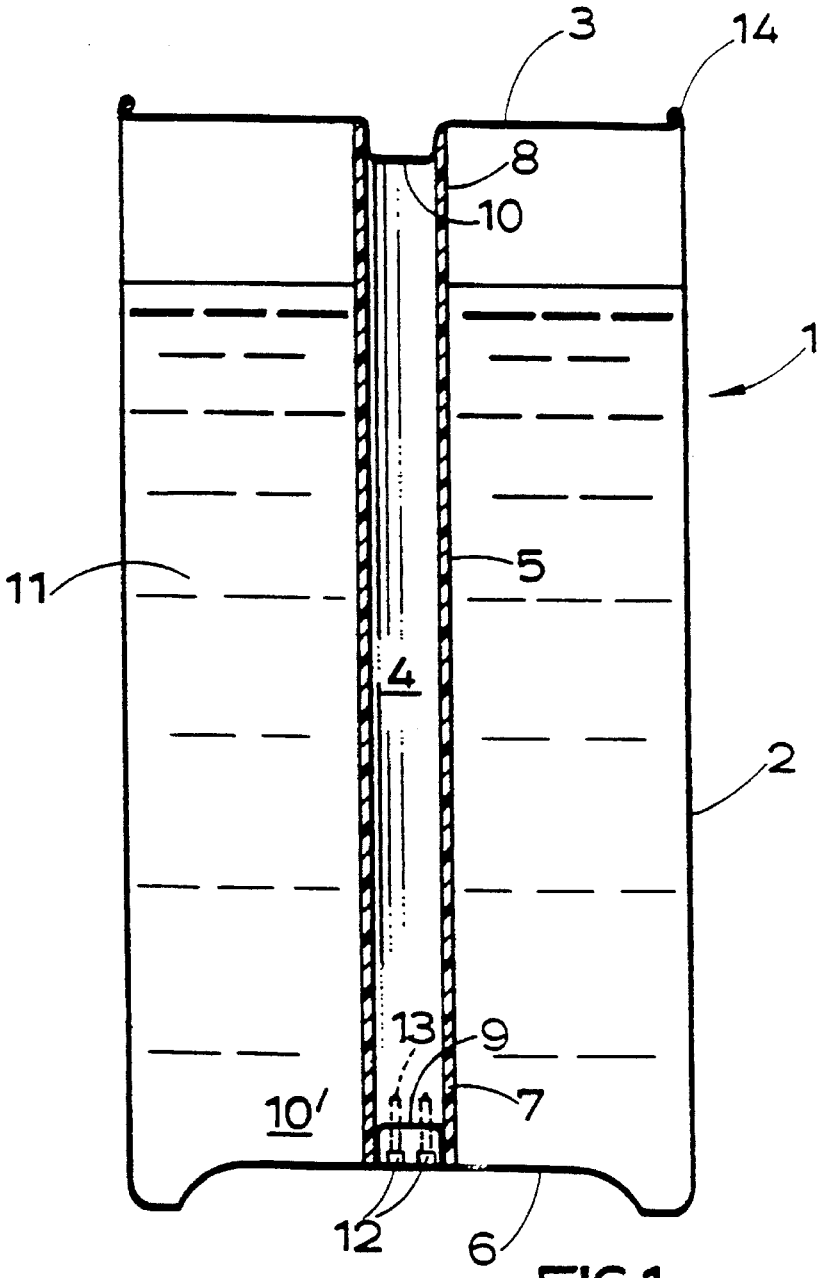
FIG. 1 is a vertical cross-section of a first beverage can unit in which the gas chamber is provided by a tube.
Figure 2:
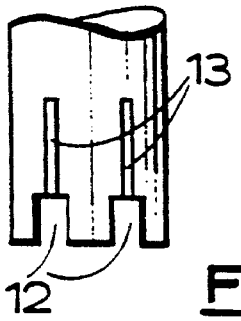
FIG. 2 is an enlarged side view of the lower end of the tube of the can unit of FIG. 1.

With reference to FIGS. 1 and 2, a beverage can unit 1 comprises a substantially conventional can body 2 closed at its upper end by a can lid 3. A gas chamber 4 is defined within a plastics tube 5 which extends axially and centrally of the can between the basal wall 6 of the can and the lid 3, the lower and upper ends 7, 8 respectively having plug and socket connections respectively with the basal wall 6 and the lid 3.

As shown the basal wall 6 and the lid 3 are each formed with a male projection 9, 10 , but it should be appreciated that it would be possible to provide either wall 6 and/or lid 3 with a female formation which receives the respective end of the tube.

The fit of the connections is such that the projections 9, 10 are sealed to the inner surface of the tube ends 7, 8. However, in order to provide an orifice means providing restricted gas communication between the gas chamber 4 and the lower region $\mathbf{10}^1$ of main chamber 11, the lower extremity of the tube 5 is castellated to provide a plurality of radial recesses 12, and from each radial recess extends an axial recess 13 in the radially outer surface of the tube 5 of a length greater than the axial length of projection 9.

It will be appreciated that, alternatively, the recesses 13 could be formed in the projection 9.

The can 2 is conveniently charged with beverage in the normal way prior to insertion of the tube 5 into the can, the tube 5 being press-fitted to the lid 3 prior to application of the lid. The lid is then applied to the can body 2 by downward movement relative to the body 2, thereby initially bringing the lower end 7 of the tube into engagement with projection 9, and then by pressing firmly down on the lid the lower end 7 is fully seated on projection 9. The upper rim 14 of the can body 2 is then spun to the lid 3. The process is carried out in a suitable gas at super-atmospheric pressure.

Figure 3:
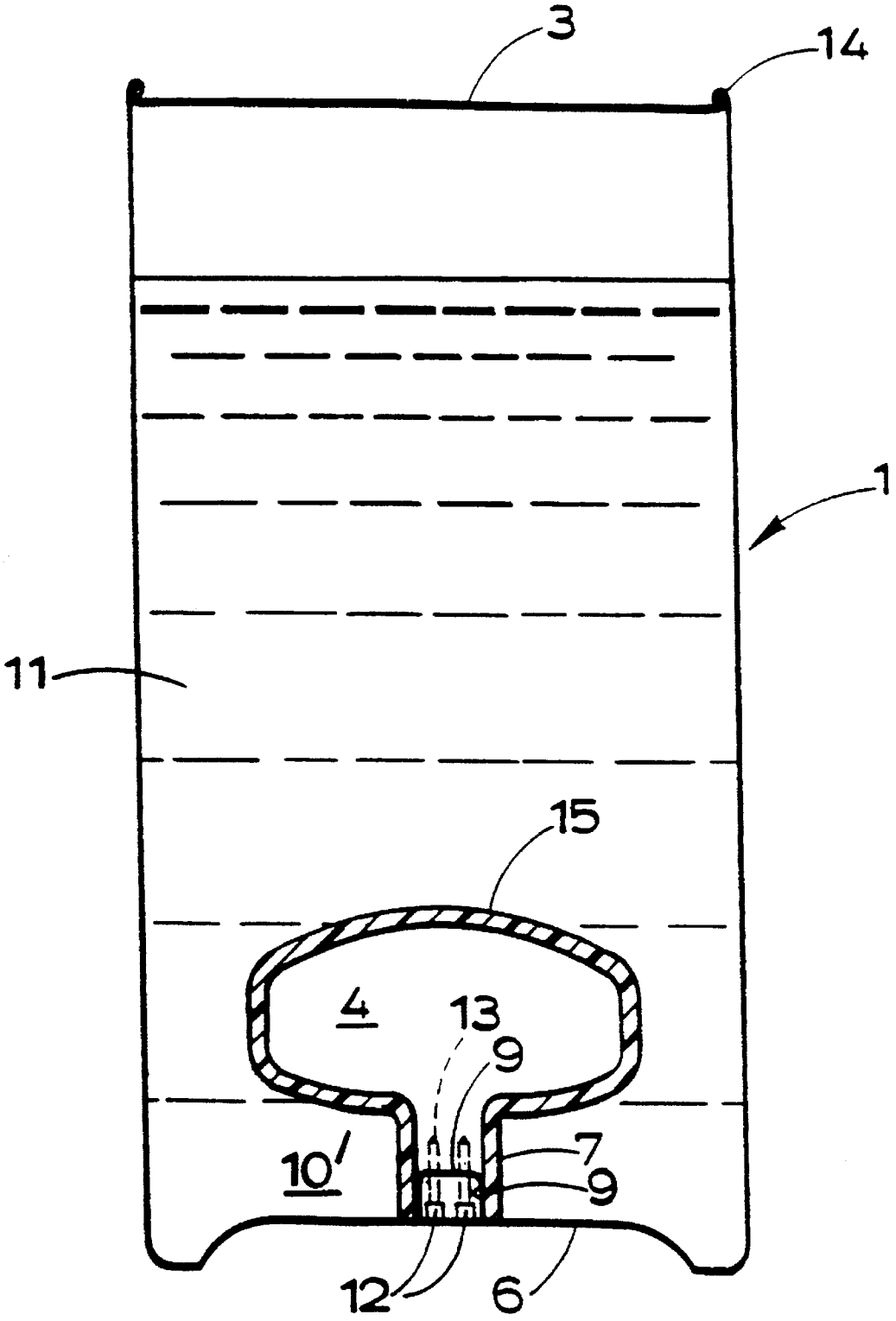
FIG. 3 is a vertical cross-section of a second beverage can unit.

In FIG. 3 parts corresponding to those of the embodiment of FIGS. 1 and 2 have been given corresponding reference numerals.

FIG. 3 shows a can in which is located a plastics gas reservoir 15 having an integral tubular attachment portion 7 which corresponds to the lower end 7 of the tube of the FIG. 1 embodiment. The details of the connection between the attachment portion 7 and projection 9 in FIG. 2 are identical to the connection between tube 5 and projection 9 in FIGS. 1 and 2.

The reservoir 15 is a firm push-fit on the projection 9, of sufficient strength to retain the reservoir 15 in position in the lower region 10, of the can during handling and any pasteurisation step.

Since the recesses 12 are located close to the bottom of the drinks chamber 11, bubbles issuing from recesses 12 on opening of the can lid 3, pass upwards through the full depth of the beverage.

The beverage packages of FIGS. 1 and 3 may be stored in an inverted condition if desired.

It will be appreciated that the shape of the reservoir 15 of FIG. 3 could be different from that shown, and that the details of the attachment 7, 9 with the basal wall 6 could be varied.

It will also be appreciated that the diameter of the tube 5 can be varied to provide the appropriate volume of the chamber 4.

Figure 4:
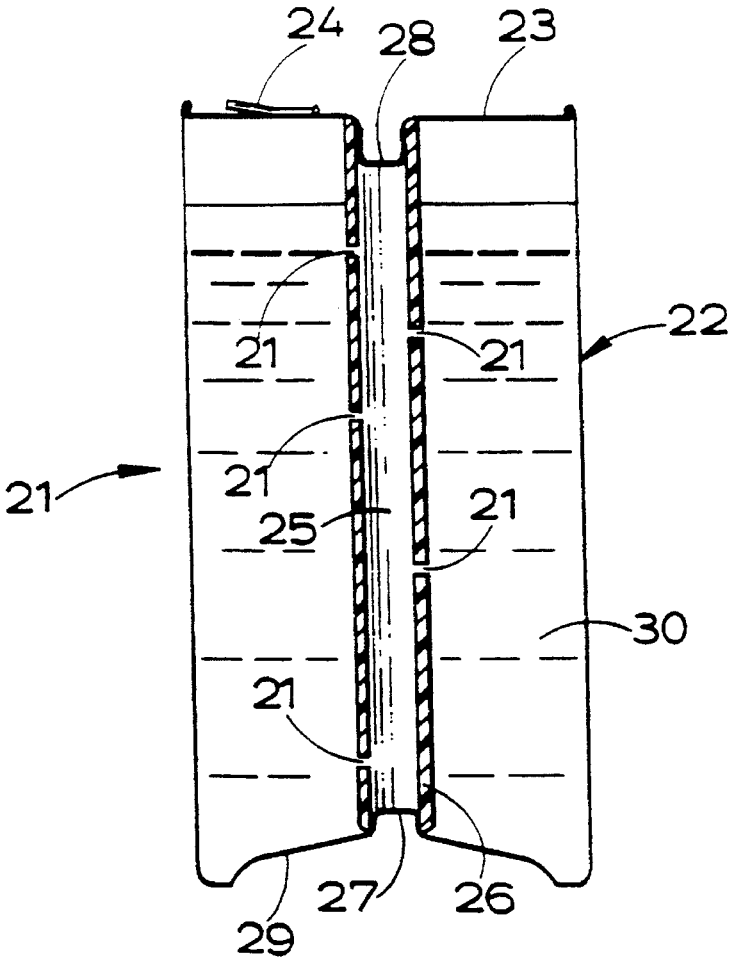
FIG. 4 is a vertical cross-section of a beverage can in which a gas reservoir is defined by a central tube located on formations on the top and bottom walls of the can.

FIG. 4 shows a drink can 21 comprising a deep drawn body 22 to which is attached in conventional manner by spinning a metal top 23 provided with a ring-pull or similar device 24 to enable the user to create a pouring opening in the top 23. A gas reservoir space 25 is provided within a plastic tube 26 which is located in place at its opposite ends by being a push-fit on central cup formations 27, 28 formed respectively in the can base 29 and can top 23.

Orifice means for enabling gas under pressure in chamber 25 to bubble into the beverage in main chamber 30, when the can top is opened, is constituted by a plurality of spaced-apart, fine radial holes 31.

In describing the other embodiments hereafter, parts corresponding to those of the embodiment of FIG. 4 will be given corresponding reference numeral s.

Figure 5:
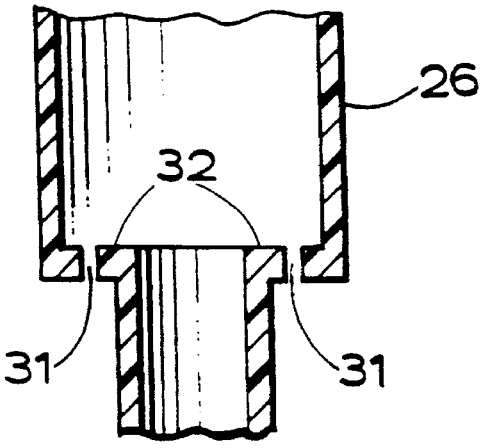
FIG. 5 is a fragmentary vertical cross-section of a modified tube for use as the reservoir in a beverage can.

FIG. 5 shows a modified tubular member 26 of stepped outline, the orifice means in this case being constituted by at least one axial hole 31 provided in the annular step 32. The advantage of the FIG. 5 reservoir tube over that of FIG. 4 is that axial holes can more easily be molded by conventional plastics molding techniques.

Figure 6:
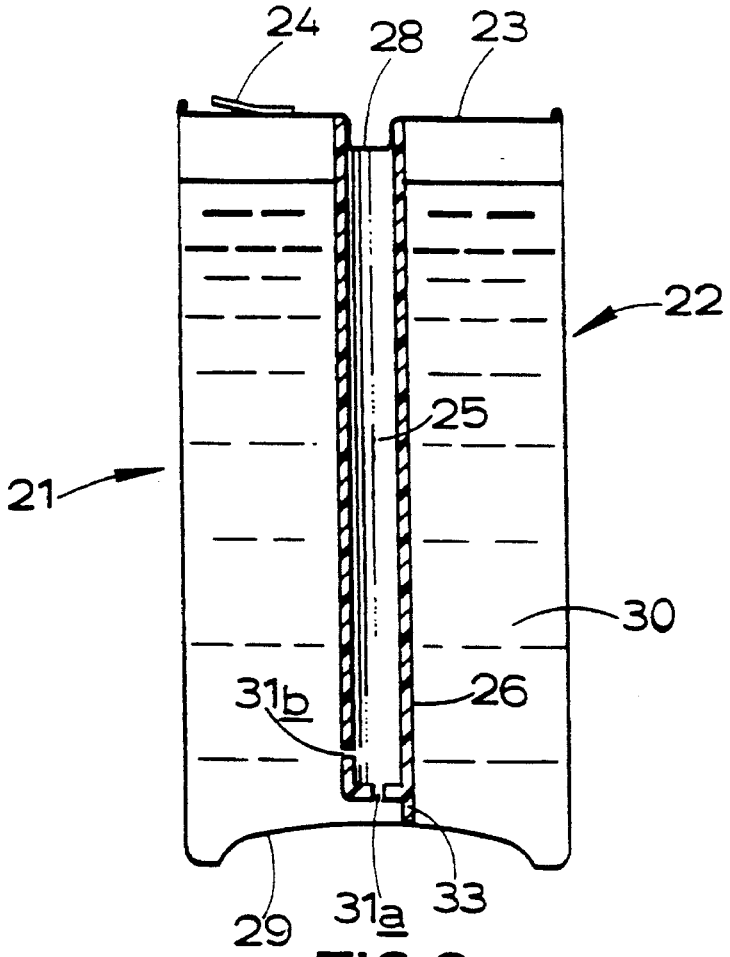
FIG. 6 is a vertical cross-section of a further beverage can in which the gas reservoir is provided by a tube which is located on a formation on the can top, but which abuts with the base of the can.

While the arrangement of FIG. 4 requires formations 27 and 28 on both the top and bottom walls of the can, the modified construction of FIG. 6 utilizes only an abutment between one end of the tubular reservoir 26 and one end-wall of the can, the can base 29 in this instance. The abutment takes place between an axial protrusion 33 on reservoir 26 and the can base 29. The orifice means is preferably provided by a hole 31a in the lower end-wall of the tubular member 26 confronting base 29, but the orifice means could be provided, as shown at 31*b*, in the side of the tubular member 26.

If desired the arrangement of FIG. 6 could be inverted, in that the formation 28 could be provided on the can base 29, and the protrusion 33 could engage with the can top 23, an orifice means 31*b* then being provided adjacent to the attached end of the tube.

An advantage of the arrangement of FIG. 6 is that the reservoir 26 can be secured to the protrusion 28 on the can top 23 prior to positioning of the can top 23 on the can body 22 and, since there is no need precisely to locate the lower end of the tube centrally of the can base, as would be necessary in the FIG. 4 embodiment, the assembly of the top 23 to the can body 22 is simplified.

Figure 7:
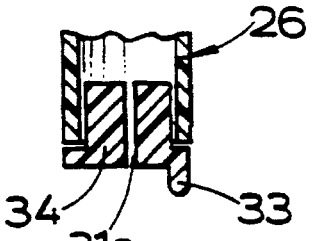
FIGS. 7 and 8 are fragmentary vertical cross-sections of the lower ends of modified tubular gas reservoirs for use in the beverage can of FIG. 6.

FIG. 7 shows a modified lower end to the reservoir 26 of FIG. 6, in which a plug 34 carrying an integral protrusion 33 is a push-fit in a length of plain tube 26.

Instead of a hole in the plug 34, one or more external grooves could be provided in the plug to define the orifice means.

Figure 8:
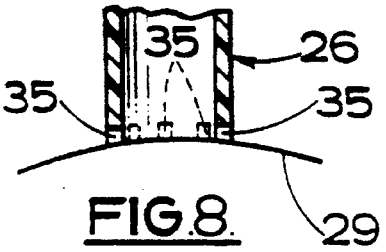

FIG. 8 shows a further modification of the tubular reservoir of FIG. 6 in which the lower end of the tube abuts directly with the can base 29, and that end is provided with one or more radial recesses 35 which define with can base 29 the orifice means. The lower end of the tube may be castellated to provide several such recesses.

Figure 9:
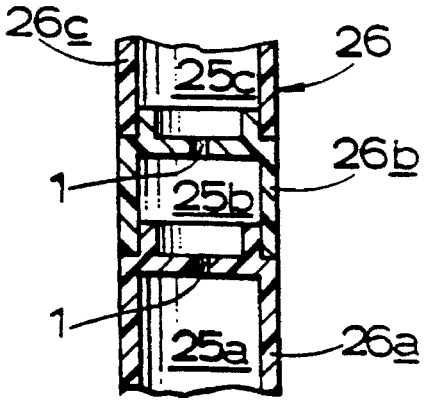
FIG. 9 is a fragmentary vertical cross-section of a tubular reservoir comprising a plurality of cup-members.

FIG. 9 shows a tubular gas reservoir 26 constructed from independently-moulded cup-shaped sections 26*a*, 26*b*, 26*c* secured together by interference fits, by adhesive or by welding. The reservoir space 25 then comprises a series of chambers 25*a*, 25*b*, 25*c* with holes 31 formed in the cup bases. Since the gas has to flow through several holes to pass into the beverage in the main chamber 30 of the can, the holes can be larger than in, say, the reservoir of FIG. 4 and, accordingly, such holes can be easier to produce.

Figure 10:
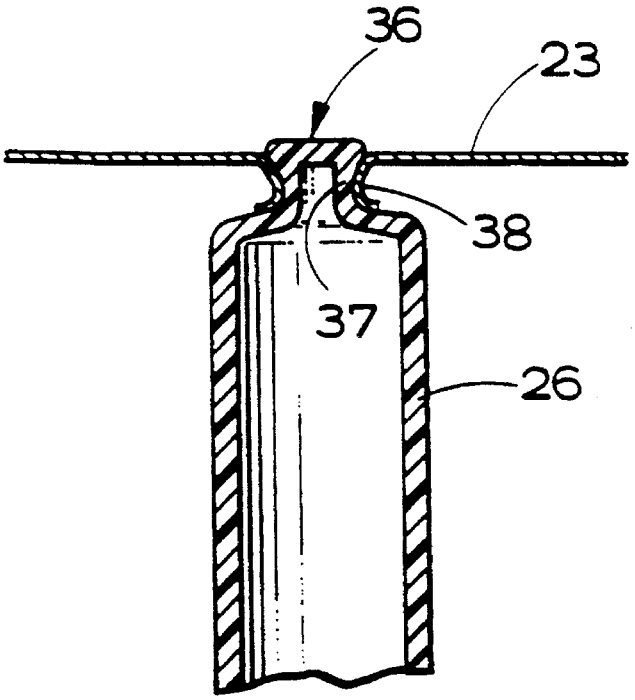
FIGS. 10, 11 and 12 are fragmentary vertical cross-sections of various connections between one end of a can and modified tubular gas reservoirs.

In the embodiment of FIG. 10, the plastics tubular reservoir 26 is formed with an axial protrusion 36 having a neck 37, the protrusion 36 being a leak-proof fit in a hole defined in the top 23 of the can by a downwardly-extending tubular boss 38 of C-shape in radial cross-section. The protrusion 36 and boss 38 are shaped to provide a tight snap-fit therebetween. In a modification, not shown, the protrusion 36 would be of generally plain cylindrical external shape, and the outer end of the protrusion would be hot or cold swaged to seal the protrusion to the top 23.

Figure 11:
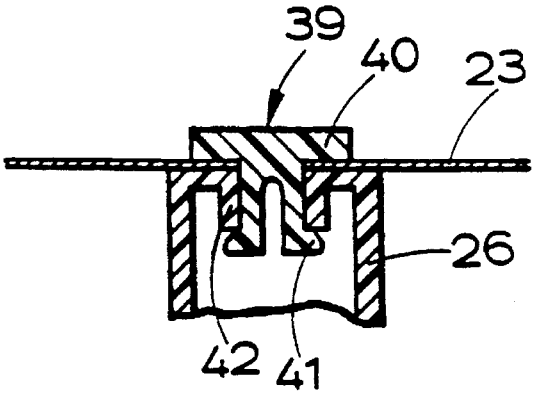

FIG. 11 shows a modification of the FIG. 10 embodiment, in which a plug 39 having an enlarged head 40 is employed to secure the tube 26 sealably to the can top 23, the inner end of the plug being provided with an annular external bead 141 which engages with the free end of a downwardly-depending tubular spigot 42 in the upper end of plastics tube 26.

Figure 12:
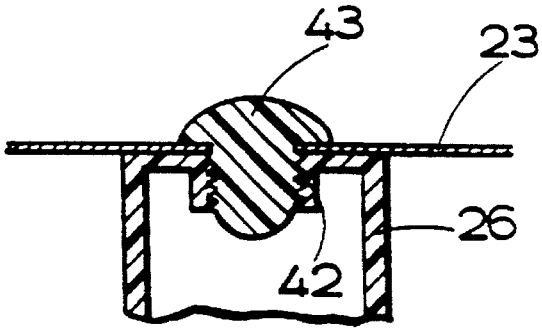

FIG. 12 shows a further modification, similar to FIG. 11, in which a screw plug 43 of a suitable material is threadedly engaged with the tubular boss 42.

Figure 13:
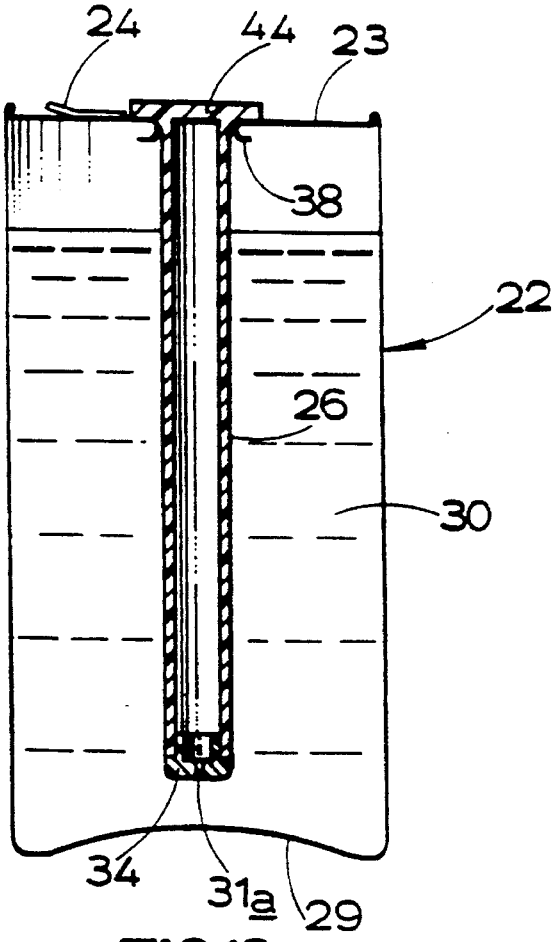
FIG. 13 is a vertical cross-section of a yet further beverage can.

FIG. 13 shows a tubular plastics gas reservoir 26 provided with a disc-shaped head 44 at its upper end, the tube being a force-fit in a hole in the can top 23 defined by a tubular boss 38 similar to that of FIG. 10 but of larger diameter. The head 44 engages with the outer surface of the top 23, and a seal is effected between the boss 38 and the tube walls 26 adjacent the head 44. The lower end of the reservoir is sealed by a plug 34 in the manner of the FIG. 7 embodiment, but there is no need to provide a projection 33, since the tight connection between the upper end of the tube 26 and the can top 23 locates the tube 26 positively in the can.

It will be appreciated that the body of the tube 26 in the FIG. 13 embodiment may be constructed as in FIGS. 5, 8 or 9. Also it would be possible for the tube instead to be fitted to the bottom 29 of the can, but then the orifice means would best be positioned adjacent the headed end of the tube 26.

Figure 14:
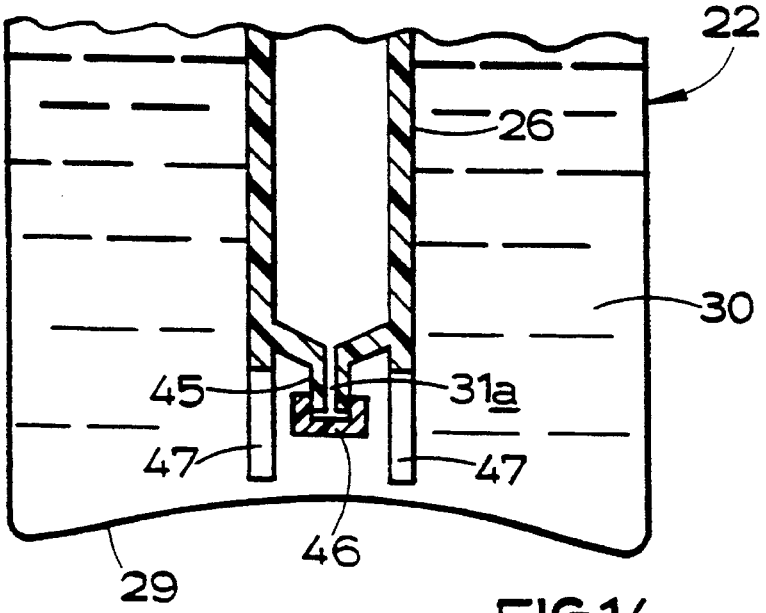
FIG. 14 is a modification of the can of FIG. 13.

FIG. 14 shows, on a larger scale, a modification of the construction of FIG. 13 in which the plug 34 is replaced by an integral nozzle 45, the bore 31*a* of which provides the orifice means, and communication through hole 31*a* is normally prevented by a cap 46 which is an interference fit on nozzle 45.

When the can is opened by operation of ring-pull 24 to release the pressure in the main chamber 30, the cap 46 is blown off nozzle 45 by the pressure of gas in the gas reservoir 26 acting over the inner face of the cap.

In order to prevent the cap 46 from leaving the open can, the tubular reservoir 26 is provided with a plurality of integral projections 47 which, together with the base 29 of the can, define a cage.

The head 44 of the tubular reservoir 26 in FIG. 14 may be provided with a charging orifice to enable the tubular reservoir to be charged with a gas such as nitrogen.

What is claimed is:

1. A beverage package comprising a sealed, openable can comprising a tubular metal can body, opposite ends of which are closed by first and second end walls, the can interior forming a chamber containing a beverage in which a gas is dissolved, and a gas reservoir assembly comprising a gas-filled reservoir of tubular form disposed longitudinally within the can body, said tubular reservoir being sealingly attached said first end wall by a push fit existing between the reservoir and the first end wall, and substantially extending to said second end wall, said reservoir being provided with gas outlet orifice means substantially adjacent to said second end wall, said gas outlet orifice means enabling gas present in the reservoir to flow into said beverage when the can is opened.

2. A beverage package as claimed in claim 1, wherein said tubular reservoir extends through a hole formed in said first end wall with a force-fit relationship, the tubular reservoir having a head portion which abuts with the outer surface of said first end wall.

3. A beverage package as claimed in claim 1, wherein the end of the tubular reservoir remote from said first end wall is closed except for a bore which defines said orifice means.

4. A beverage package as claimed in claim 3, wherein said closed end of tubular reservoir is closed by a cap which is an interference fit on the reservoir.

5. A beverage package as claimed in claim 1, wherein said tubular reservoir comprises an open-ended tube and the reservoir is attached to both the first and second end walls by means of oppositely-disposed spigots formed by the end walls, each of said spigots being a push-fit in the respective end of the tube.

6. A beverage package as claimed in claim 5, wherein said orifice means are defined by castellations formed in the end of the tube adjacent said second end wall.

7. A beverage package comprising a sealed, openable can comprising a tubular metal can body, opposite ends of which are closed by first and second end walls, the can interior forming a chamber containing a beverage in which a gas is dissolved, and a gas reservoir assembly comprising a gas-filled reservoir of tubular form disposed longitudinally within the can body, said tubular reservoir being sealingly attached to said first end wall by a push fit existing between the reservoir and the first end wall, and substantially extending to said second end wall, said reservoir being provided with a plurality of gas outlet orifice means spaced along said tubular reservoir between said first and second end walls, said gas outlet orifice means enabling gas present in the reservoir to flow into said beverage when the can is opened.

* * * * *